United States Patent [19]

Wienand et al.

[11] 4,101,689

[45] Jul. 18, 1978

[54] ANTISTATIC AND/OR ELECTRICALLY CONDUCTIVE FLOOR COVERING, AS WELL AS PROCESS FOR THE PRODUCTION THEREOF

[75] Inventors: Michael Wienand, Siegburg; Ernst Juch, Troisdorf, both of Fed. Rep. of Germany

[73] Assignee: Dynamit Nobel Aktiengesellschaft, Fed. Rep. of Germany

[21] Appl. No.: 372,528

[22] Filed: Jun. 22, 1973

[30] Foreign Application Priority Data

Jun. 22, 1972 [DE] Fed. Rep. of Germany ..... 2230578

[51] Int. Cl.[2] ..... B05D 5/12; B05D 3/12

[52] U.S. Cl. ..... 427/122; 427/58; 427/123; 427/126; 427/209; 427/289; 427/290; 427/316; 427/372 R; 427/385 R; 156/252; 156/256

[58] Field of Search ..... 117/226, 227, 8, 4, 117/212, 47 H, 213; 156/252, 256; 427/58, 122, 126, 209, 289, 372 R, 385 R, 123, 316, 290

[56] References Cited

U.S. PATENT DOCUMENTS

| | | | |
|---|---|---|---|
| 2,907,925 | 10/1959 | Parson | 117/212 |
| 3,118,789 | 1/1964 | Wiswell | 117/213 |
| 3,171,756 | 3/1965 | Marshall | 117/8 |
| 3,194,681 | 7/1965 | Nicholson | 117/4 |
| 3,562,009 | 2/1971 | Cranston | 117/212 |
| 3,649,263 | 3/1972 | Tubuko | 117/201 |
| 3,708,289 | 1/1973 | Timmerman | 117/201 |

*Primary Examiner*—Michael F. Esposito
*Attorney, Agent, or Firm*—Craig & Antonelli

[57] ABSTRACT

An antistatic and/or electrically conductive floor covering which comprises a sheet of a thermoplastic synthetic resin which is substantially electrically non-conductive, said sheet having a plurality of holes penetrating therethrough and electrically conductive material filling said holes with one side of the sheet being coated with said conductive material so that the materials in each of said holes are connected to one another.

10 Claims, 8 Drawing Figures

FIG. 1
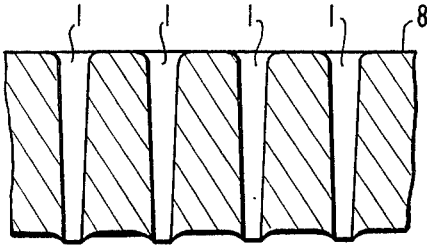
FIG. 2
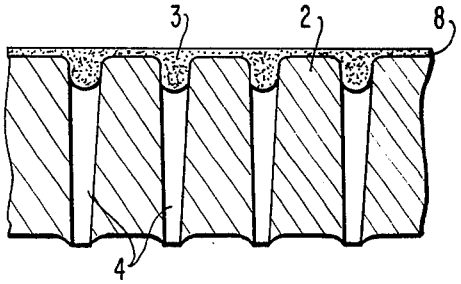
FIG. 3
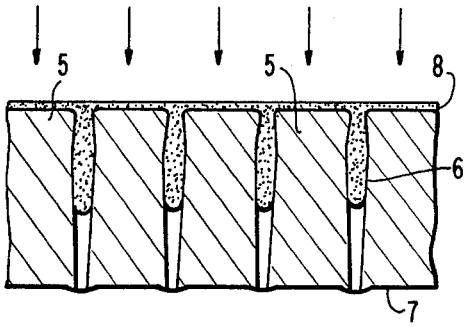
FIG. 4
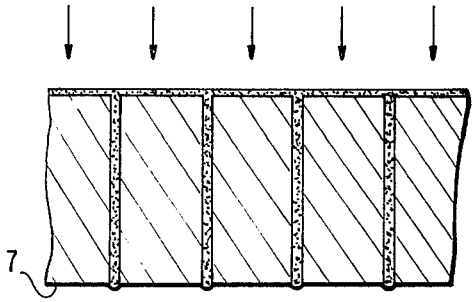
FIG. 5
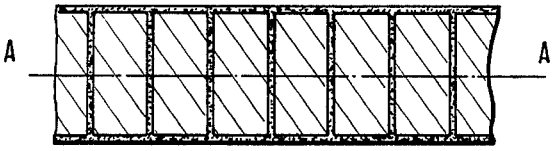
FIG. 6
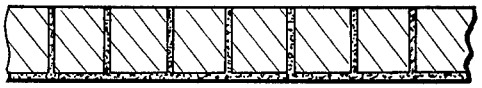
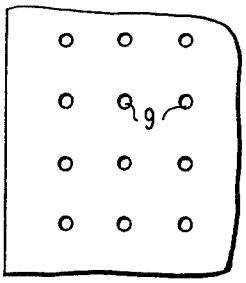
FIG. 7
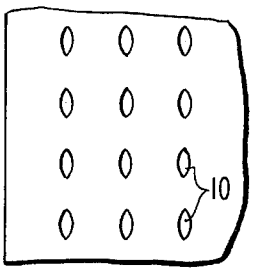
FIG. 8

ANTISTATIC AND/OR ELECTRICALLY CONDUCTIVE FLOOR COVERING, AS WELL AS PROCESS FOR THE PRODUCTION THEREOF

This invention relates to an antistatic and/or electrically conductive floor covering, made of a sheet or sheet sections of a thermoplastic synthetic resin which are not at all or hardly electrically conductive.

In order to render synthetic resins electrically conductive, it has been known to employ electric conductors, such as metals or metal oxides (i.e. $Fe_2O_3$,) carbon black or graphite in pulverized form. In these processes, the conductive material, mainly carbon black, must be incorporated into the synthetic resin substance in relatively large amounts by mixing, masticating, calendering, or extrusion. The quantitites of conductive agent to be incorporated must be very large in order to obtain the desired conductive properties. This has the disadvantage that great quantities of dust are generated during the incorporation of such large amounts of carbon black or metal powder; furthermore, the thus-produced articles show a low tensile strength at rupture, especially at temperatures of below 0° C. Finally, the appearance of such coverings is very monotonous, so that they cannot be employed in home construction as esthetically effective surfaces.

Therefore, this invention is based on the problem of providing a floor covering of the type mentioned hereinabove, as well as a process for the manufacture thereof, which covering can be produced in a simple manner while avoiding the above described disadvantages.

This problem is solved by a floor covering of the type mentioned in the foregoing, wherein holes or passages filled with an electrically conductive material penetrate the sheet (generally at right angles to one surface), and one side of the sheet is coated with this conductive material, so that the fillings of the holes, i.e. the material therein, are joined with one another. In other words, the conductive material in the holes form a plurality of thread-like projections that extend from the material coated onto the sheet.

Such a floor covering is produced by heating the sheet to a temperature of between 40° and 60° C.; punching or otherwise forming holes into the sheet, which holes penetrate into the sheet; then applying a paste of a conductive material to one side of the sheet so that a portion of the paste enters the holes; thereafter heating the sheet from the side to which the paste has been applied to above 60° C. whereby, due to the contraction of the holes in the hotter zone, the paste is forced to the other side of the sheet. A floor covering produced in this manner is installed with the side provided with the solidified paste facing downwardly, so that the visible topside has the appearance of the selected thermoplastic synthetic resin. The resin can consist, for example, of polyvinyl chloride (PVC), polyolefins, e.g. polypropylene and polyethylene, and/or the copolymers thereof, (with PVC being the preferred resin), with or without plasticizers, fillers, stabilizers, lubricants, light-colored, especially white coloring agents, and otherwise customary auxiliary substances for such resin. Further examples of suitable resins and compositions thereof are disclosed in U.S. Pat. No. 3,381,067.

The holes or passages suitably have a conical configuration, the paste then being applied to the side having the larger hole diameter. A conductive paste consists, for example, of 12.2% carbon black, 68% plasticizer, e.g. dioctyl phthalate 0.4% of a stabilizer, e.g. resorcinol disalicylate, and 19.4% E-PVC.

If the pasty composition forced through the holes has exited on the visible topside, this exuded mass can be removed by an aftertreatment, for example by abrading.

The floor covering can be produced especially advantageously by applying the paste to both sides of a hole-permeated, heated sheet of thermoplastic resin and pressing the paste through the holes, whereafter the sheet is cut through horizontally so that it has half its previous thickness. The cut surfaces then constitute the topsides of the covering.

The floor covering of this invention has the advantage that it has an esthetic appearance, in addition to its antistatic and/or non-conducting properties, this appearance being determined by the selected synthetic resin and/or the pattern thereof. The small apertures on the topside filled with the paste of conductive material do not interfere with the total appearance and can contribute toward the effect of a pattern if appropriately arranged.

Various embodiments of the invention will be described in greater detail below with reference to the accompanying drawings wherein:

FIG. 1 is a sectional view of a fragment of a floor covering sheet having conical holes punched into the sheet;

FIG. 2 shows a section of a sheet shown in FIG. 1 after a paste has been applied;

FIG. 3 shows a section of the sheet shown in FIG. 2 upon the application of heat through the surface on the paste side;

FIG. 4 shows a section of the sheet after the holes are filled in with paste;

FIG. 5 shows a section of a sheet wherein the holes are filled with the paste from both surfaces;

FIG. 6 shows the sheet according to FIG. 5 after it has been mechanically separated;

FIG. 7 shows, in a top view, a fragment of a sheet with the arrangement of holes each having a circular cross section; and FIG. 8 shows, in a top view, a fragment of a sheet with the arrangement of holes each having a lanceted cross section.

The embodiment shown in FIGS. 1 to 4 illustrates one possibility of manufacturing a floor covering according to this invention. In the sheet section shown in FIG. 1, holes 1 are punched into the sheet of polyvinylchloride resin from its surface 8; these holes extend entirely through the sheet. The sheet is heated to a temperature of between 40° and 60° C. For punching purposes, a needle or a needle board with an arrangement of needles is provided, the needles having an average diameter of about 2 mm. in the illustrated embodiment. After the sheet has been punched with the holes, a paste 3 of a conductive material i.e. one containing 16.6% by weight of carbon black having a grain size of 20 to 30 millimicrons, 72.2% by weight of dioctyl phthalate and 11.2% by weight of PVC, is applied to the sheet surface 8 by means of a doctor blade or by rolling. The paste penetrates to a certain depth designated by reference numeral 4 into the holes 1 from the side having the large hole apertures. As shown in FIG. 3, by arrows, heat is applied to the sheet from sheet surface 8 on which the paste 3 has been provided. The heat fed to the sheet is metered so that the temperature of the sheet 2, starting with zone 5, is heated up to above 60° C., for example to the gelling temperature of the paste. This has the effect that the punched holes 1 contract in the first-heated zone 5, whereby the paste is forced in the form of a paste skein or thread like projection 6 further into the each respective hole 1 and to the opposite sheet surface 7. The penetration depth 4 according to FIG. 2 is dimensioned so that this advancement in the form of the paste projection 6 through the holes 1 can be effected during the aforementioned heating step and sufficient material is provided for the filing of the holes. In case of the sheet section shown in FIG. 4, the heat supply indicated by the arrows is just sufficient to fill the holes 1 completely with the paste. If the paste exits from the holes 1 on the sheet surface 7, this sheet surface, which is subsquently employed as the topside of the covering, is subjected to an aftertreatment, for example by abrading, so that a smooth topside is obtained wherein only the cross section of the solidified paste projection terminates on the surface after cooling and thus is visible.

In the embodiment shown in FIGS. 5 and 6, holes have been punched through the sheet from both sheet surfaces, the paste being applied to both sheet surfaces and heat being fed from both sides in order to convey the paste through the holes by contraction of the sheet material. After the filling of the holes, wherein the respective paste projections, after penetrating through the holes, are combined with the paste layer on the opposite sheet surface, the sheet is separated horizontally in the center of its thickness after solidification of the paste, so that two sheets are obtained, the sheet surface coated with solidified paste being the underside and the cut surfaces, characterized in FIG. 5 by the section line A, being, respectively, the topside of the covering sheets.

As can be seen from FIGS. 7 and 8, the holes can be punched in a regular arrangement; if necessary, the holes can also be provided in corresponding patterns. In the embodiment shown in FIG. 7, the cross section 9 of the holes is circular, while this cross section is of a lancet shape in the embodiment of FIG. 8, which is denoted by reference numeral 10.

It will be appreciated that in preparing the conductive paste, carbon black is preferably used as the electrically conductive component, having a grain size of, for example, 20 to 30 millimicrons. However, conductive metallic compounds, e.g. $Fe_2O_3$, are also suitable. Moreover, a plasticizer, such as dioctyl phthalate or alkylarylsulfonic acid esters or the like, is added to the conductive paste, and optionally a small amount of a stabilizer such as those disclosed in the aforementioned U.S. patent. Besides, a certain proportion of PVC is added to the paste. The ratio of the plasticizer to the PVC in the conductive paste can be varied within wide limits, but about 50–70% by weight of plasticizer with about 40–20% by weight of PVC, based on the mixture, is preferred. Preferably, about 5–14% by weight of carbon black, based on the total weight of PVC-plasticizer, is added to the conductive paste.

Also, in accordance with this invention, the finished floor covering has preferably a thickness of 2 mm., but the thickness of the covering can vary, preferably in a range of from about 1–3 mm. The conductive layer applied to one side of the thermoplastic sheet generally amounts to only a few tenths of a millimeter.

As for the production of the holes or perforations in the sheet to be filled with the conductive paste, it is possible to employ needles of various cross sections. In case of needles having a round cross section, the diameter of the needles is preferably from about 2–3 mm. In case of needles having a rectangular cross section, the dimensions vary preferably between 2 and 3 mm. × 0.5 mm. In case of a triangular cross section of the needle, with an equilateral triangle, the length of one side can vary between 3 and 5 mm. In case of a square needle, the length of the side of the square can likewise range between 3 and 5 mm. However, it will be appreciated that these sizes are preferred embodiments, which can be varied in dependence on the thickness of the covering to be produced and the composition of the conductive paste. The spacing of the individual holes, with the above-mentioned hole sizes, is approximately 8–10 mm., wherein this distance likewise depends on the conductive values to be achieved and especially also the paste to be employed. This means, therefore, that the conductivity of the floor covering can be varied by the recipe of the paste, the hole cross section, and the spacing of the holes.

In summary, the primary aspects of the process of this invention are as follows:

The thermoplastic material displaced when the needles are punched into the sheet material to produce the holes tends to return to its original position at the required gelling temperature; thereby, the filling or thread of conductive material formed in the hole by the conductive paste is prestressed. This thread of conductive material is extended along a maximally short path from the visible side of the floor covering to the backside of the floor covering; thereby, the cross section of the conductive thread can be kept relatively small. This also provides the possibility to render the conductive threads substantially invisible when using carbon-free conductive materials.

Advantageously, the desired conductivity of the floor covering can be predetermined. When using the conductive threads in a decorative pattern, it is possible to obtain purposeful optical effects by a corresponding selection of the hole cross sections and corresponding needle cross sections (in case of a rectangular needle cross section, a narrow, short dash results as the conductive point on the surface after filling of the hole; when a triangular cross section is selected for the needle, the conductive thread appears on the surface as a "Y"; and when the needle has a square cross section, the thread of conductive material has the shape of a cross).

It will thus be appreciated that the process can also be utilized in case of a non-conductive floor covering, exclusively for attaining optical effects. It is possible, in accordance with the process of this invention, to obtain geometrically exact, as well as arbitrarily scattered color effects by the distribution of the holes.

While the novel embodiments of the invention have been described, it will be understood that various omissions, modifications and changes in these embodiments may be made by one skilled in the art without departing from the spirit and scope of the invention.

What we claim is:

1. A process for the production of a floor covering of a thermoplastic synthetic resin having a paste containing conductive material incorporated therein in the form of a plurality of thread-like projections connected together, which comprises heating a thermoplastic resin sheet to a temperature of between 40° and 60° C; punching holes that penetrate completely through the heated sheet; applying a paste containing a conductive material and plasticized synthetic resin to one side of the heated sheet so that the paste penetrates into the holes; and then heating the sheet to above 60° C. from the side where the paste has been applied, whereby, due to the contraction of the holes in the hotter zone, the paste is forced through to the other side of the sheet to form said thread-like projections within said holes.

2. The process of claim 1, in which the paste is applied to both sides of the hole-permeated, heated sheet and is forced through the holes by contraction due to the heating step, and the sheet is finally separated in the middle of its thickness.

3. The process of claim 1, in which the thermoplastic resin includes polyvinyl chloride, polyolefins, and copolymers of vinyl chloride and copolymers of olefins.

4. The process of claim 1, in which the electrically conductive material within said paste comprises particles of carbon black, conductive metals, conductive metal compounds, or graphite.

5. The process of claim 1, in which the paste cotains from 5 to 14% by weight of said conductive material.

6. The process of claim 1, in which the synthetic resin contained in said paste is the same as the synthetic resin forming said thermoplastic sheet.

7. The process of claim 6, in which the synthetic resin is polyvinyl chloride.

8. The process of claim 1, in which said floor covering has a thickness of from 1 to 3 mm.

9. The process of claim 1, in which a plurality of said holes are punched completely through the heated sheet by piercing the sheet with a plurality of needles, whereby said holes are produced by displacement of the thermoplastic synthetic resin in the zones of said holes.

10. The process of claim 1, in which the paste contains from about 50 to 70% by weight of plasticizer and about 40 to 20% by weight of synthetic resin.

* * * * *